US005954393A

United States Patent [19]

Perrin

[11] Patent Number: 5,954,393

[45] Date of Patent: Sep. 21, 1999

[54] CHAIR WITH REMOVABLE WORKSURFACE

[75] Inventor: Thomas M. Perrin, Grand Rapids, Mich.

[73] Assignee: Haworth, Inc., Holland, Mich.

[21] Appl. No.: 09/086,177

[22] Filed: May 28, 1998

[51] Int. Cl.[6] ..... A47B 39/00

[52] U.S. Cl. ..... 297/161; 297/188.18

[58] Field of Search ..... 297/188.18, 135, 297/160, 161, 162, 174, 440.1, 173, 411.26

[56] References Cited

U.S. PATENT DOCUMENTS

| | | |
|---|---|---|
| D. 261,577 | 11/1981 | Heritage . |
| D. 261,578 | 11/1981 | Heritage . |
| D. 261,579 | 11/1981 | Heritage . |
| D. 296,731 | 7/1988 | Hollington . |
| D. 303,184 | 9/1989 | Hollington . |
| D. 385,423 | 10/1997 | Shields . |
| 951,145 | 3/1910 | McGenniss . |
| 993,493 | 5/1911 | Young . |
| 2,635,680 | 4/1953 | Zentmire . |
| 2,755,845 | 7/1956 | Robin . |
| 2,994,366 | 8/1961 | Hoch . |
| 3,197,254 | 7/1965 | Hendrickson . |
| 3,216,764 | 11/1965 | Junkunc . |
| 3,239,272 | 3/1966 | Wilkins . |
| 3,265,436 | 8/1966 | La Bombard et al. . |
| 3,353,866 | 11/1967 | Chapman et al. . |
| 3,368,842 | 2/1968 | Polsky . |
| 3,408,104 | 10/1968 | Raynes . |
| 3,535,000 | 10/1970 | Protzmann . |
| 3,550,892 | 12/1970 | Propst . |
| 3,567,277 | 3/1971 | Van Ryn . |
| 3,717,375 | 2/1973 | Slobodan . |
| 3,814,474 | 6/1974 | Baker et al. . |
| 3,968,992 | 7/1976 | Hogan . |
| 4,203,624 | 5/1980 | Hopkins . |
| 4,300,798 | 11/1981 | Musgrove et al. . |
| 4,316,634 | 2/1982 | Roesler . |
| 4,427,232 | 1/1984 | Malm . |
| 4,500,134 | 2/1985 | Kaneko et al. . |
| 4,576,351 | 3/1986 | Brink . |
| 4,672,898 | 6/1987 | Davidson . |
| 4,779,922 | 10/1988 | Cooper . |
| 4,925,240 | 5/1990 | Peters . |
| 5,048,428 | 9/1991 | LaRue . |
| 5,169,210 | 12/1992 | Fricano . |

FOREIGN PATENT DOCUMENTS

| | | |
|---|---|---|
| 467401 | 6/1937 | United Kingdom . |

*Primary Examiner*—Milton Nelson, Jr.
*Attorney, Agent, or Firm*—Flynn, Thiel, Boutell & Tanis, P.C.

[57] ABSTRACT

A chair including a worksurface assembly which is selectively mounted to an arm of the chair. A connecting structure interface between the chair arm and worksurface assembly allows the worksurface assembly to be easily removed from and remounted on the chair arm. The worksurface assembly when removed from the chair operates as a mobile worksurface for the user. The worksurface assembly has a tablet defining an upper worksurface thereon. The tablet is pivotable relative to the base into selected use positions when the base is mounted on the chair arm.

20 Claims, 7 Drawing Sheets

CHAIR WITH REMOVABLE WORKSURFACE

FIELD OF THE INVENTION

This invention relates to an improved chair including a removable worksurface.

BACKGROUND OF THE INVENTION

It is known to provide a chair assembly having a seat and integral worksurface. This assembly is often referred to as a desk. The worksurface is provided on the chair to provide a surface on which a person may place items and/or provide a working surface, such as a surface for taking notes during a meeting or presentation, etc., while the person is sitting in the chair. The worksurface is conventionally permanently attached to the chair. Thus, the person must remain sitting in the chair to comfortably and properly utilize the worksurface. This limits the person's mobility during a meeting as the worksurface is not mobile. In many meeting rooms, it may be necessary to move about to view demonstrations or exchange communications with others, and the known chairs as described above do not provide flexibility as to permitting use of the worksurface at multiple positions or locations.

Another drawback of known chairs of this type is that the worksurfaces conventionally have a single fixed use position. However, since people vary greatly in size and preferred working positions, most conventional chairs do not allow the worksurface to be adjusted to comfortably accommodate different people.

While some known chairs have a worksurface which pivots from a use position to a storage position adjacent one side of the chair, which storage position allows the chair to be used without the worksurface and improves the ease of entry and exit of a user into and from the chair, nevertheless this type of pivoting capability does not provide for adjustment of the use position of the worksurface for different users.

Accordingly, it is an object of this invention to provide a chair assembly having a removable worksurface on a chair which allows the user to easily remove the worksurface and use the worksurface when removed from the chair. The removability and portability of the worksurface enables the user to move about a room while carrying and using the worksurface.

It is a further object of this invention to provide a simple interface between the chair and worksurface which allows the worksurface to be securely but removably attached to the chair and also allows a person to efficiently remove the worksurface without the operation of external devices to effect release of the worksurface from the chair.

A still further object is to provide a chair assembly, as aforesaid, which permits the use position of the worksurface to be readily adjusted.

The present invention relates to a chair assembly which includes a chair and separable worksurface. The worksurface includes a planar tablet mounted on a base which defines a mounting part. The chair includes an arm extending therefrom to support an arm of a person seated in the chair. The chair arm has a pad on its upper surface for supporting a person's arm, and a mounting part for releasably engaging the corresponding mounting part of the worksurface. The mounting part on the chair arm includes a stem which extends beneath the pad, and the mounting part on the worksurface base defines a socket for receiving the stem therein. A releasable securement means holds the stem in the socket such that the worksurface is usable by a person seated in the chair. The releasable securement means permits the worksurface to be separated from the chair such that the worksurface is usable remote from the chair. The securement means includes a ball detent mechanism which cooperates between the stem and the socket.

The tablet, in a preferred embodiment, is pivotable into multiple use positions relative to the base.

Other objects and purposes of this invention will be apparent to persons acquainted with apparatus of this general type upon reading the following specification and inspecting the accompanying drawings.

Figure 1:
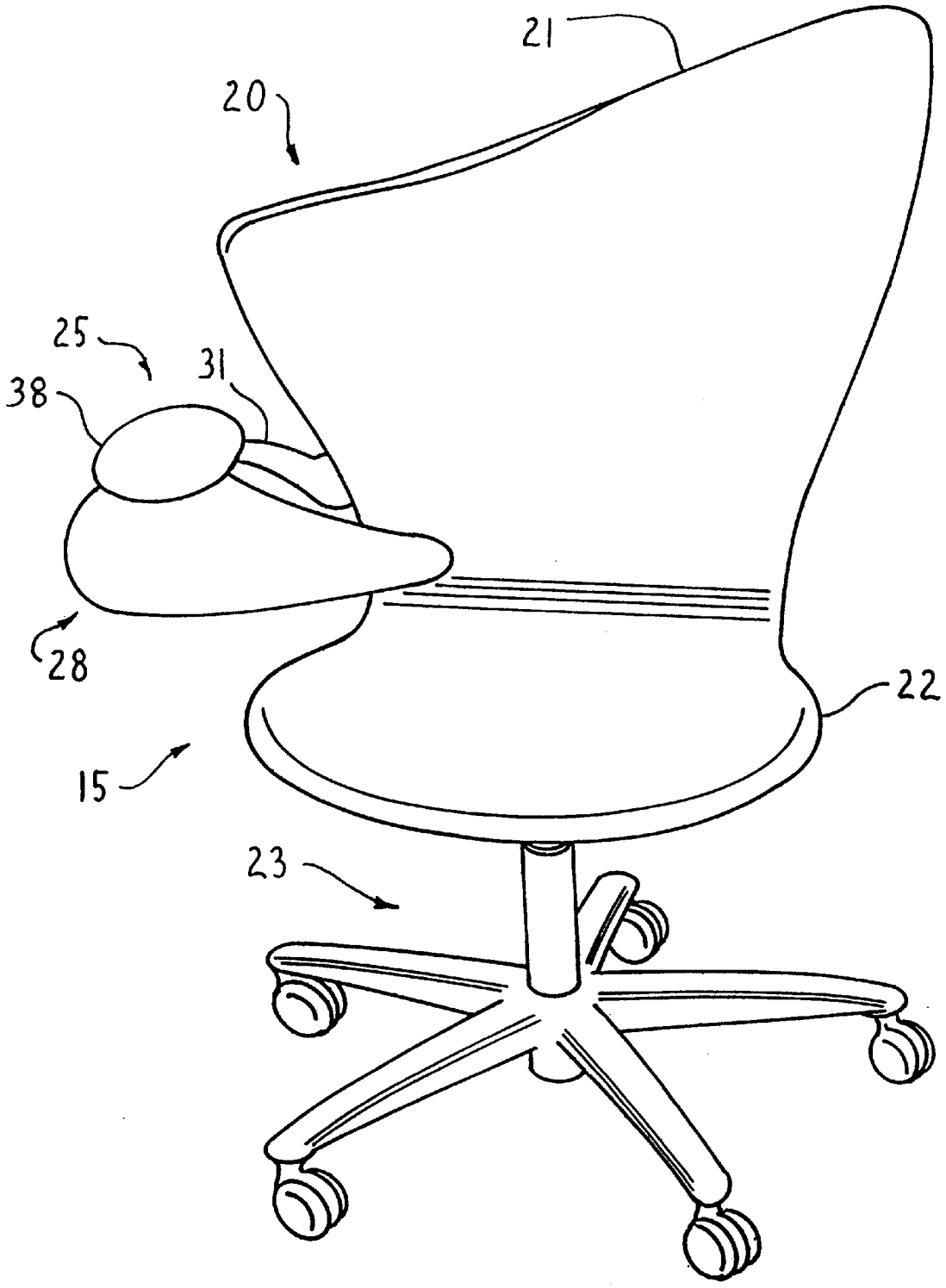
FIG. 1 is a perspective view of a chair assembly with a removable worksurface assembly according to the invention.

Certain terminology will be used in the following description for convenience in reference only and will not be limiting. For example, the words "up", "down", "right", and "left" will generally designate directions in the drawings, and may also refer to the orientation of a person seated in the chair. The words "front" and "back" will refer to the orientation of a person seated in the chair. Said terminology will include derivatives and words of similar meaning.

DETAILED DESCRIPTION

Referring to FIG. 1, there is shown a chair assembly 15 including a chair 20 having a vertically extending back 21, a seat 22 horizontally cantilevered from a lower end of the chair back 21, and a base or leg arrangement 23 extending between the bottom of the seat and a support surface such as a floor. The base arrangement 23, as is conventional, may be adjustable to space the seat 21 at different heights above the floor.

Figure 3:
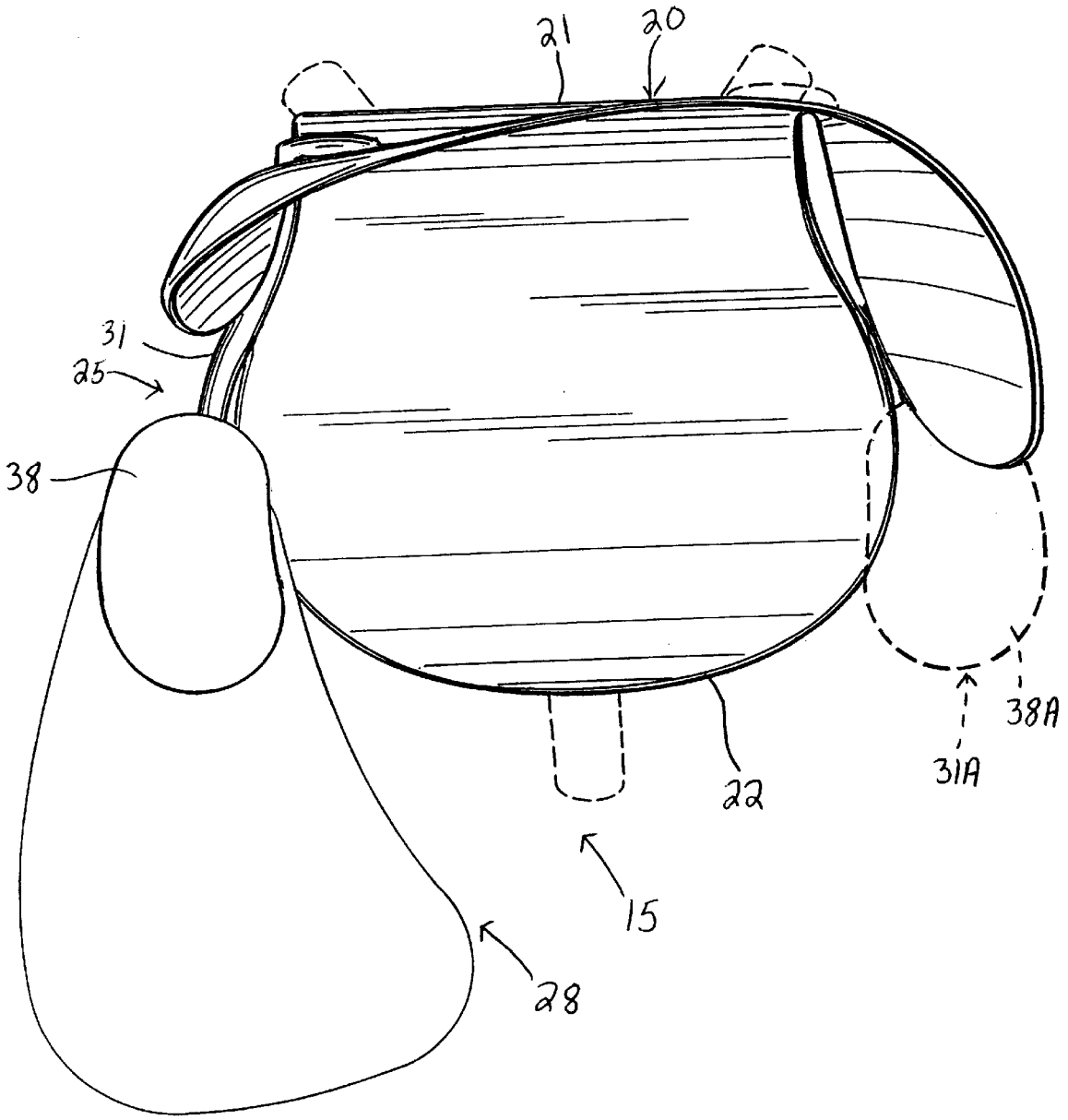
FIG. 3 is a top view of the chair assembly of FIG. 1.

The chair 20, in the illustrated embodiment, has a single arm rest assembly 25 cantilevered forwardly from a one side of the back 21 so as to be positioned vertically above one side edge of the seat 22. A worksurface assembly 28 is removably secured to the free end of the armrest assembly 25. Armrest assemblies may be provided on both sides of the chair for supportive engagement of a person's arms if desired, although only one armrest assembly is provided with the removable worksurface assembly 28 (FIG. 3).

Figure 2:
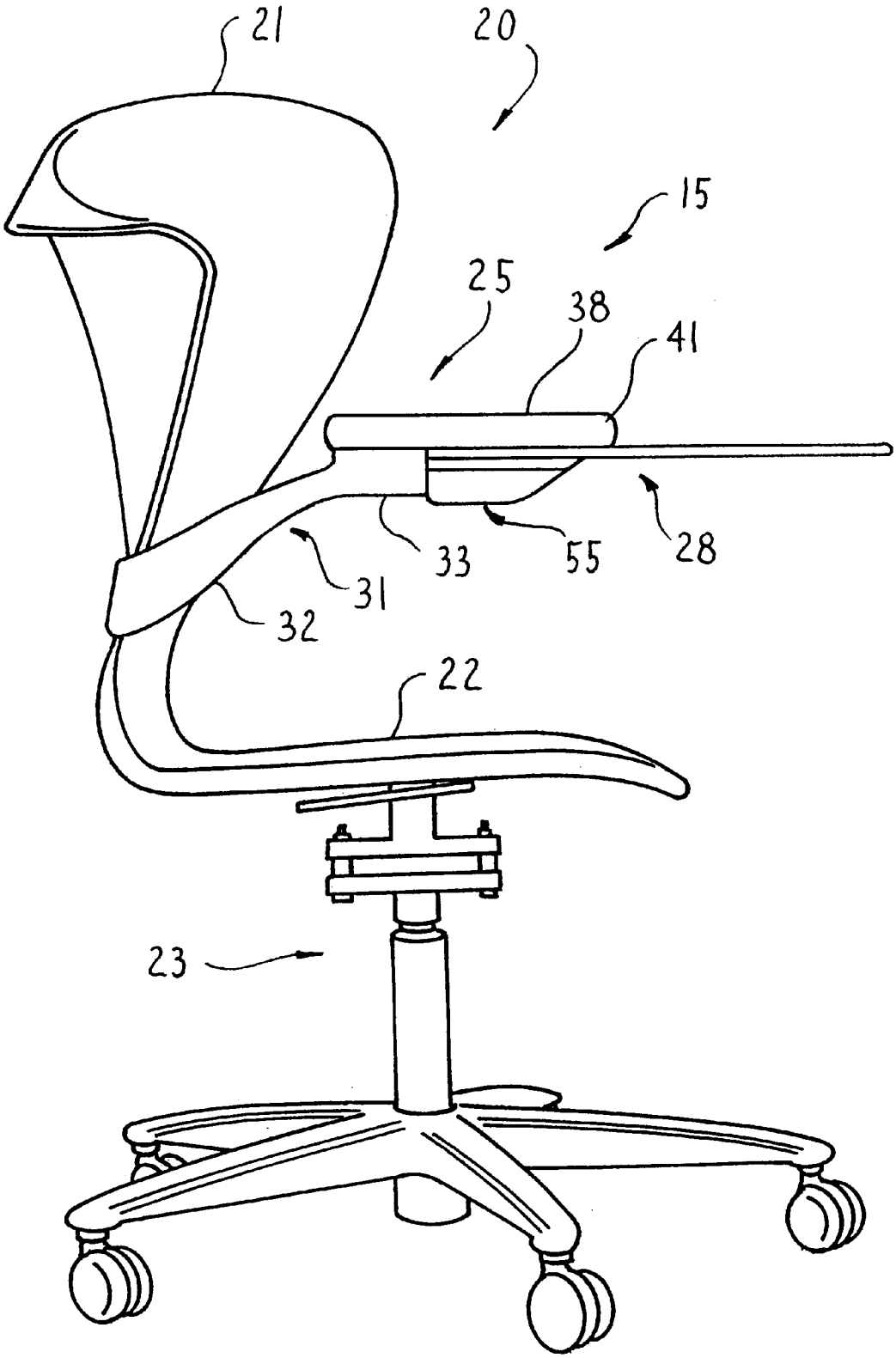
FIG. 2 is a side view of the chair assembly of FIG. 1.

The armrest assembly 25 includes an elongate arm 31 having a generally upwardly inclined arm portion 32 cantilevered from the lower portion of the back 21 (FIG. 2). As illustrated, the armrest assembly 25 extends from an edge of the back 21 so that the arm 31 extends along the right side of a person seated on the chair 20 and is spaced upwardly from the seat 22. The armrest assembly may also extend along the left side of the chair if desired, and would be a mirror image of the described armrest assembly 25. The upwardly inclined arm portion 32 is integrally joined with a substantially horizontal arm portion 33 which defines the free end of the arm and defines thereon an upper surface 36. A cushioned arm pad 38 is conventionally secured to the upper surface 36. The pad 38 has an end portion 41 extending beyond an end surface 42 of the horizontal arm portion 33. The arm pad 38 extends essentially horizontally and is adapted to comfortably receive an arm of a user on an upper surface thereof. Pad 38 may have a cloth or vinyl outer cover surrounding a padding which in turn surrounds a core mounting material.

Figure 4:
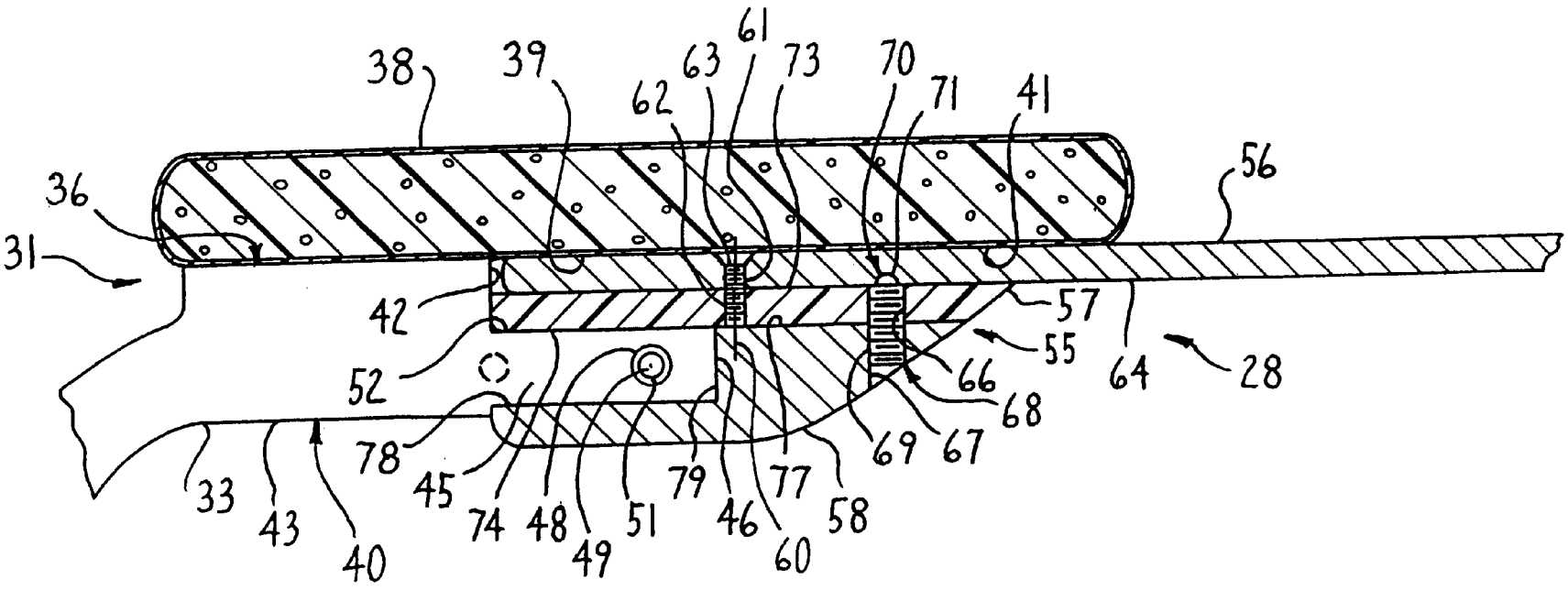
FIG. 4 is an enlarged cross sectional view of portions of the chair arm and worksurface assembly joined together.
Figure 5:
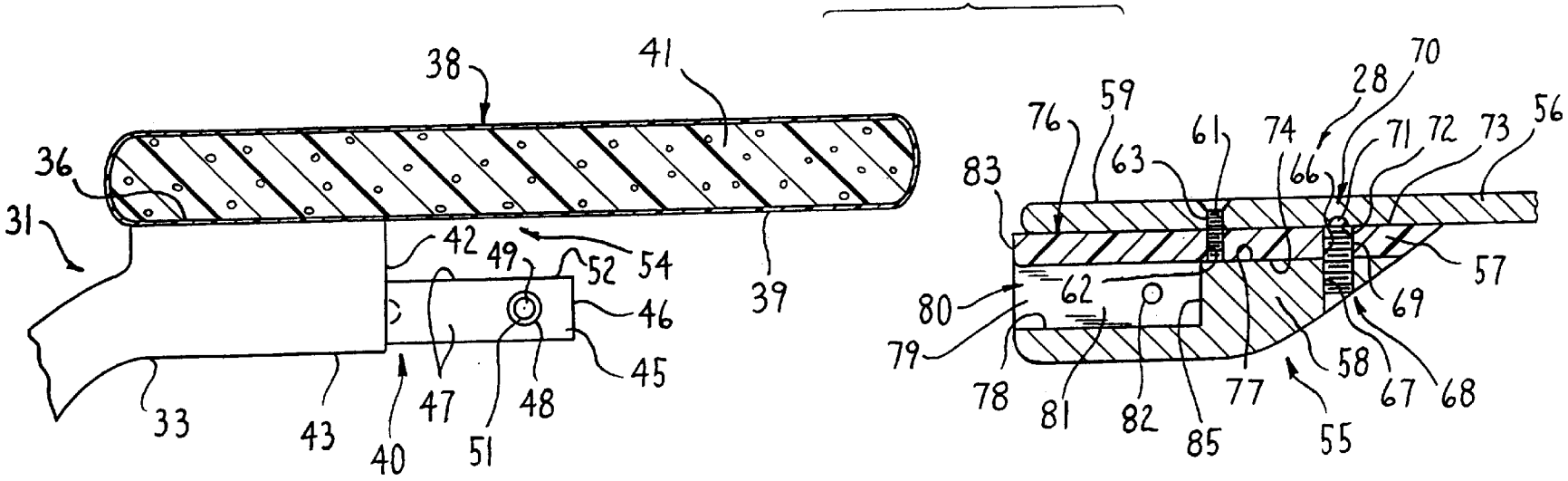
FIG. 5 is a view similar to FIG. 4 but showing the worksurface assembly removed from the chair arm.
Figure 6:
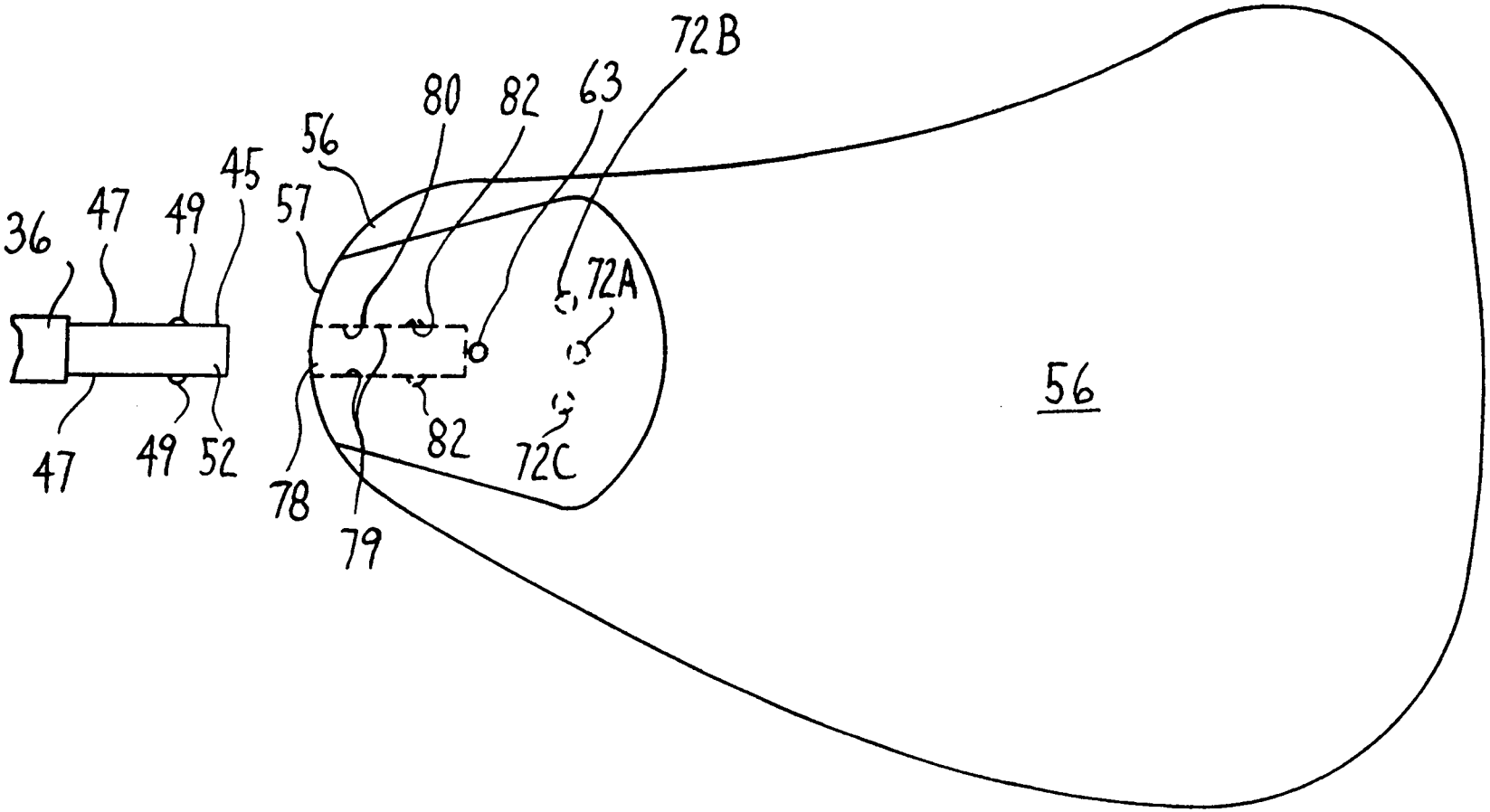
FIG. 6 is a bottom view showing the chair arm and worksurface assembly in a separated condition.

The arm 31 includes a male mounting part 40 for engagement with the worksurface assembly 28. Thus, mounting part 40 includes a projection or stem 45 cantilevered horizontally outwardly from the end 42 of the horizontal arm portion 33 and offset downwardly from the lower surface 39 of the pad 38. The stem 45 is integral with and extends outwardly generally parallel to the longitudinal axis of the horizontal arm portion 33. The stem 45 is positioned upwardly from a lower surface 43 of the horizontal arm portion 33, whereby the cross section of the stem 45 is smaller than the cross section of the horizontal arm portion 33. The stem 45 in the illustrated embodiment is generally rectangular in cross section and has a free end surface 46 spaced forwardly from the arm end 42, and has generally planar side surfaces 47 extending from the arm end 42 to the end surface 46. The end surface 46 of the stem 45 is disposed beneath the pad 38 so that the stem is totally covered by the pad when viewed from above. Thus, the pad 38 covers and prevents contact between a user's arm and the stem 45 when the worksurface assembly 28 is removed (FIG. 4). A slot 54 is defined between the lower surface 40 of the pad 38 and an upper one of side surfaces 47. The slot 54 opens laterally at both sides and at a forward longitudinal end thereof remote from arm end 42.

A detent-type retaining structure is associated with the stem 45 and includes apertures 48 that are positioned in the sidewardly facing surfaces 47 and accommodate therein worksurface assembly securement or detent members 49. Detent members 49 extend beyond the plane of the side surfaces 47 in their usual biased state. The detent members 49 may be rounded objects, such as balls or pins, received in the apertures 48 and biased outwardly by springs (not shown) positioned within the apertures and biasing the detent members 49 outwardly. Holding rings 51 are mounted at the mouth of the apertures 48 to hold the securement members 49 therein. The detent members 49 have a slightly greater diameter than the holding rings so as to be seated thereby and to extend partially beyond the planes of the side surfaces 47. The detent members 49 are retractable into the apertures 48 when a force is applied thereto overcoming the outward biasing force of the spring. Such resilient detent arrangements are conventional.

The worksurface assembly 28 includes a plate-like tablet 56 mounted on a base 55 which, in the illustrated embodiment, is defined by an intermediate structural member 57 and a lower structural member 58. The structural members 57, 58 can be defined by a single integrally structured member if desired. The base 55 permits removable securement of the worksurface assembly 28 to the chair arm 31, and permits pivotal support of the tablet 56. The tablet 56 is positioned on top of the intermediate member 57, and has a larger upper surface area than the base 55. The tablet 56 is generally at least about three times the length of the base 55 to provide adequate work space on the planar and substantially horizontal upper surface 59 thereof. The base 55 has a length longer than the stem 45, and height and width greater than the stem 45. In the joined state of the worksurface assembly 28 and chair arm 31, the end surface of the base 55 abuts the arm end 42 of the horizontal portion 33 of the chair arm 31 (FIG. 4). The rear edge of tablet 56 is spaced a small distance forwardly from the arm end 42 providing clearance space to permit pivoting of the tablet, as discussed below. The base 55 defines a female mounting part 80 for removably securing the worksurface assembly 28 to the chair arm 31 as described below.

The tablet 56 and base 55 have aligned, coaxial apertures 61, 62 respectively for receiving a fastening pivot 63 which secures the tablet 56 and intermediate member 57 together. The fastening pivot 63, in the illustrated embodiment, is threaded into only aperture 62 so that the longitudinal axis 60 of the fastening pivot 63 defines a generally vertical axis about which the tablet 56 can horizontally pivot relative to the intermediate member 57. The fastening pivot 63 is positioned beneath the pad 38 and the axis 60 extends perpendicular to the upper surface 59 of the tablet 56. The pivot axis 60 is closely adjacent to the inner end of the tablet to allow the outer end of tablet 56 (i.e., the end remote from the chair arm 31 in the assembled state) to travel a greater distance than the inner end of the tablet when the latter is pivoted.

A downward facing surface 64 of the tablet 56 has detent recesses 72 (three recesses 72A, 72B, 72C in the illustrated embodiment) formed therein in opposed relation to an upper surface of the base 55. The recesses 72 are positioned in an arc generated about the axis 60 as a center.

Intermediate member 57 has a second aperture 66 therein which is coaxial with an aperture 67 in the lower member 58 in the assembled state of the base. The apertures 66, 67 generally align with the arc defined by the detent recesses 72 in the tablet 56. A fastener 68 is positioned within the apertures 66, 67 to fixedly secure the lower member 58 to the intermediate member 57. A detent mechanism 70 extends upwardly from one end of the fastener 68 above an upper surface 73 of the intermediate member 57. The detent mechanism 70 is a conventional ball detent including a retractable ball 71 which can be urged downwardly against a spring (not shown) so that an uppermost point of the ball 71 is generally coplanar with the upper surface 73 of the intermediate member 57. The detent recesses 72 of tablet 56 receive the detent ball 71 in its normally upward biased state to selectively stationarily position the tablet 56 relative to the base 55. The illustrated embodiment shows the three detent recesses 72A, 72B, 72C defining three positions A, B, C (FIG. 7) of the tablet 56 relative to the base 55 when the latter is mounted on the chair arm. It will be recognized that the invention is not limited to only three illustrated selectable detented positions of the tablet.

Figure 7:
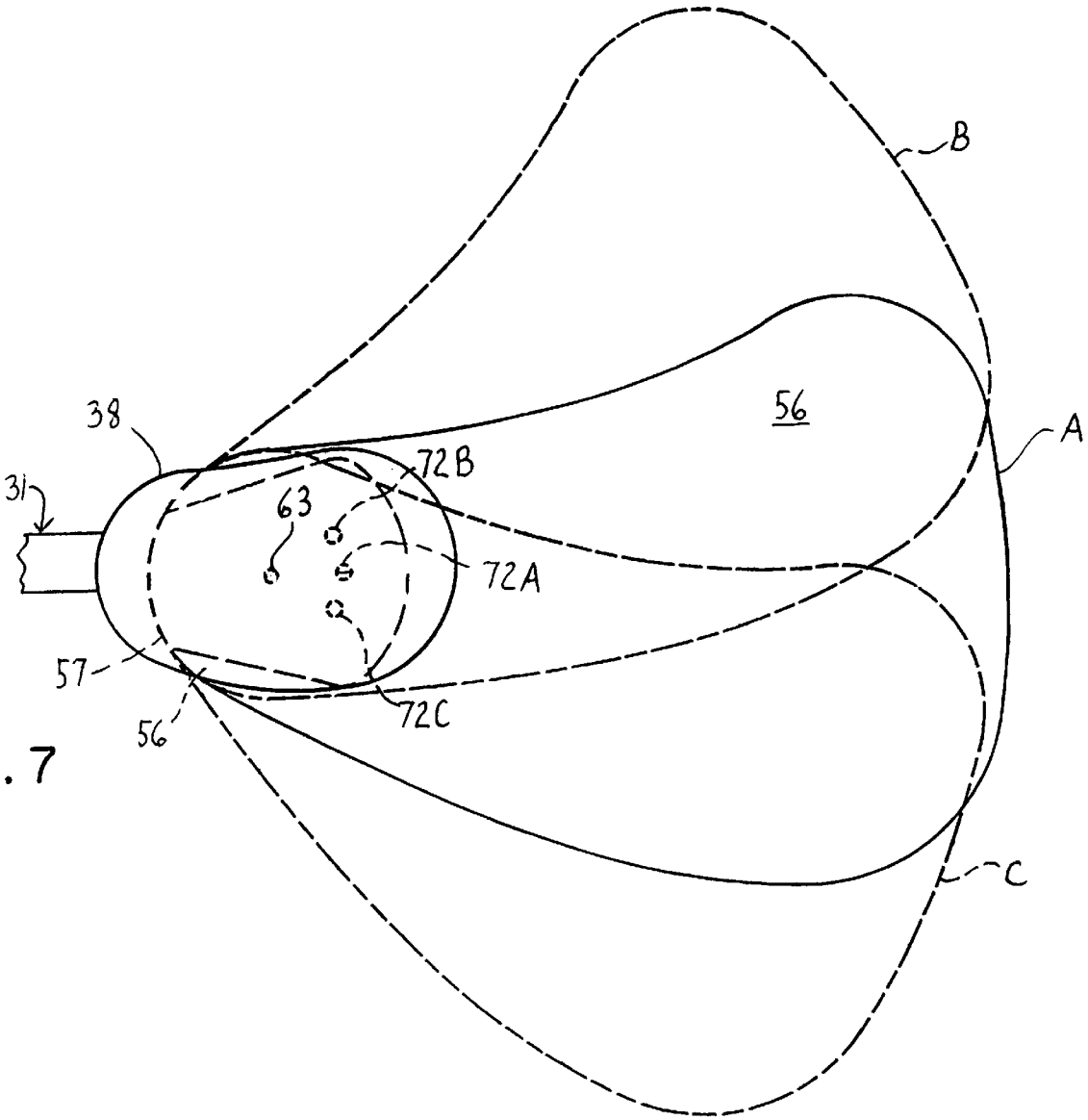
FIG. 7 is a top view of the worksurface assembly mounted on the chair arm and showing the worksurface assembly in a central position in solid line and in outwardly and inwardly pivoted positions in dash and double-dash lines, respectively.

The intermediate position A of the tablet 56, as is shown in solid line in FIG. 7, is defined by the ball 71 being received in the central recess 72A. The tablet 56 extends forwardly from the chair arm 31 generally in alignment therewith in this intermediate position thereof. The outer end portion of tablet 56 remote from the chair arm widens relative to the inner end portion such that the outer end portion of the tablet extends slightly in front of a person seated in the chair. An inward angled position B of the tablet 56 is shown in dashed line and is held therein by the ball 71 being received in the recess 72B. The outer end portion of the tablet 56 remote the chair arm 38 extends in front of a person seated in the chair 20 to a greater extent in the inward position B than in the intermediate position A. An outward angled position C of the tablet 56 is shown in double-dash line and is held therein by the ball 71 being received in the recess 72C. The outer end portion of the tablet 56 remote from the chair arm 38 extends sidewardly away from a person seated in the chair 20 to a greater extent in the outward position C than in the intermediate position A.

The worksurface assembly also includes a female mounting part 80 defined on the base 55 and adapted for releasable engagement with the arm mounting part 40. The female mounting part 80 includes an elongate blind bore or socket 81 which projects forwardly from the rear surface 83 of the base and terminates at a front end wall 85. The cross section of socket 81 corresponds in size and shape (i.e. rectangular) to the cross section of stem 45 so that the latter can be snugly slidably inserted into the socket.

Detent recesses 82 are formed in the opposed side surfaces 79 of the socket 81 for engagement with the detent members 49 carried on the stem 45. The detent members 49 normally extend outwardly from the stem side surfaces 47 and are removably engageable in the detent recesses 82 of the mounting part 80. The receipt of the detent members 49 in the detent recesses 82 provides a releasable securement of the worksurface assembly 28 to the chair arm 31 without additional external apparatus which must be engaged by a user to selectively secure or release the worksurface assembly 28 to or from the chair 20.

The use of the chair assembly 15 will now be briefly described.

A user mounts the worksurface assembly 28 onto the chair arm 31 by generally aligning the base 55 with the stem 45 of the chair arm 31, and then accurately aligning the socket 81 of mounting part 80 with the stem 45. The worksurface assembly is then manually moved rearwardly to insert the stem 45 into the socket 81. The detent members 49 carried on the stem 45 contact the side surfaces of the socket 81 and are recessed into the stem 45, overcoming the outward biasing force acting on the detent members 49. Once the stem 45 is received in the socket 81 at the proper depth, the detent members 49 align with the detent recesses 82 of the mounting part 80 and are urged by the associated spring (not shown) into the detent recesses 82, thereby securing the worksurface assembly 28 to the chair arm 31.

Once the worksurface assembly 28 is secured to the stem 45 and chair arm 31, a user may prefer to use the tablet 56 at a different angle. To rotate the tablet 56 into a different use position, a person grasps the tablet 56, preferably by the side edges thereof, and forcibly horizontally rotates the tablet about the pivot axis 60. The ball 71 of the detent mechanism 70 as received in one of the detent recesses 72 contacts an edge of the one detent recess and is forced downwardly into the detent mechanism 70 against the spring force. The tablet 56 is further pivoted and the ball 71 rides on the lower surface 64 of the tablet until the ball 71 is received in another of the detent recesses 72A, 72B, 72C corresponding to the user desired position of the tablet 56. The tablet 56 is shown in FIG. 7 as having three detent recesses 72A, 72B, 72C corresponding to the three tablet positions A, B and C.

The worksurface assembly 28 can be easily removed from the arm 31 generally by a reversing of the above mounting procedure. More specifically, when a user desires to remove the worksurface assembly 28 from the chair arm 31, he grasps the worksurface assembly 28, preferably along opposite longitudinal edges of the tablet 56, and forces or pulls the worksurface assembly 28 forwardly away from the arm 31. The force provided by the user overcomes the holding force biasing the detent members 49 into the detent recesses 82, causing the detent members 49 to be cammed inwardly against the spring force allowing the base 55 to be slidably removed from the stem 45 of the chair arm 31. The worksurface assembly 28 may then be freely carried about a meeting room when removed from the chair arm 31. The person carrying the worksurface assembly 28 thus has a mobile worksurface, i.e. the tablet 56, on which the person may write.

When the tablet 56 is removed the chair arm 31, the chair 20 may be used as a standard chair since the arm pad 38 totally covers the stem 45 and hence prevent user contact therewith.

If either necessary or desirable, the chair can be provided with arms on both sides thereof. FIG. 3 shows the chair 20 having two arms 31, 31A. The right arm 31 has the mounting part 40 as described above for securing the worksurface assembly 28 thereto. Both arms 31, 31A have pads 38, 38A thereon for the comfort of the user. It is also possible for the left arm 31A to have a mounting part 40 associated therewith so that a worksurface assembly 28 may be mounted on the left side of the chair if desired.

Although a particular preferred embodiment of the invention has been disclosed in detail for illustrative purposes, it will be recognized that variations or modifications of the disclosed apparatus, including the rearrangement of parts, lie within the scope of the invention. More specifically, the present invention will not be limited to the shape of the tablet, stem, socket, or chair unless specifically claimed. The invention also is not limited to the three pivotal positions of the tablet unless specifically claimed. It will be understood that additional or fewer pivotal tablet positions lie within the scope of the invention.

The embodiments of the invention in which an exclusive property or privilege is claimed are defined as follows:

1. A chair assembly comprising a chair having an arm extending therefrom and a worksurface assembly having a horizontal planar working surface, a mounting stem extending essentially horizontally from and essentially parallel to said arm, a cushioned arm pad mounted on said arm wholly covering said mounting stem from above to prevent contact of a person's arm against said stem, said worksurface assembly including a base and a tablet mounted on said base, said tablet defining said working surface, said base having a socket adapted to receive said stem therein, a releasable retainer joining said base and said stem so that said worksurface assembly is removably secured to said stem in a worksurface assembly mounted position, said mounted position orienting said tablet forwardly of said chair for use by a person seated in said chair, said releasable retainer having a securement force securing said stem and socket together, said worksurface assembly being movable outwardly from said stem by a force at least slightly greater than said securement force to release said socket from said stem so that said worksurface assembly is removable from said chair arm and is usable remote from said chair.

2. The chair assembly according to claim 1, wherein a pivot mounts said base and tablet together and defines an upright pivot axis that allows horizontal pivoting of said tablet relative to said base to a plurality of use positions, said plurality of use positions including a first position directly in front of a person seated in the chair and a second position horizontally offset from said first position, said base including a detent mechanism extending upwardly therefrom, said tablet having a plurality of detent recesses therein corresponding to the plurality of use positions, said detent mechanism being alignable to one of the plurality of detent recesses and being engaged therewith to retain said tablet in one of said first and second positions, said detent mechanism retaining said tablet in said one position by a retaining force, said tablet being pivoted about said pivot axis upon receipt of a horizontally directed force slightly greater than said retaining force.

3. A chair assembly, comprising a chair having a chair arm disposed adjacent at least one side thereof, the chair arm having a first mounting part provided thereon, a worksurface assembly including a worksurface member having an enlarged upper surface defining a worksurface and having a base mounted to an underside of said worksurface member, said base having a second mounting part releasably engaged with said first mounting part to removably mount said worksurface assembly on said chair arm, one of said mounting parts including a stem and the other of said mounting parts including a socket removably receiving said stem so as to removably secure said worksurface assembly to said chair arm, and a releasable retaining structure for normally removably securing said second mounting part in engagement with said first mounting part, said retaining structure including recesses in said socket and securement members on said stem, said recesses receiving said securement members to releasably secure said worksurface assembly to said chair arm.

4. A chair assembly, comprising a chair having a chair arm disposed adjacent at least one side thereof, the chair arm having a first mounting part provided thereon, a worksurface assembly including a worksurface member having an enlarged upper surface defining a worksurface and having a base mounted to an underside of said worksurface member, said base having a second mounting part releasably engaged with said first mounting part to removably mount said worksurface assembly on said chair arm, a releasable retaining structure for normally removably securing said second mounting part in engagement with said first mounting part, and said chair arm including an arm pad which covers said first mounting part from above when said worksurface assembly is detached from the chair arm.

5. The chair assembly according to claim 4, wherein one of said mounting parts includes a stem and the other of said mounting parts includes a socket removably receiving said stem so as to removably secure said worksurface assembly to said chair arm, said stem being cantilevered from said chair arm, and said arm pad covers said stem from above to prevent contact with said stem from above by an arm of a person seated in said chair when said worksurface assembly is detached from said chair arm.

6. The chair assembly according to claim 5, wherein the worksurface assembly includes a platelike tablet, and wherein the arm pad overlies a rear end portion of said tablet.

7. A chair assembly, comprising a chair having a chair arm disposed adjacent at least one side thereof, the chair arm having a first mounting part provided thereon, a worksurface assembly including a worksurface member having an enlarged upper surface defining a worksurface and having a base mounted to an underside of said worksurface member, said base having a second mounting part releasably engaged with said first mounting part to removably mount said worksurface assembly on said chair arm, and a releasable retaining structure for normally removably securing said second mounting part in engagement with said first mounting part, said retaining structure comprising a resilient detent mechanism to removably secure said worksurface assembly on said first mounting part, said worksurface assembly being removable from said chair arm by manually applying a separation force of predetermined minimum magnitude to said worksurface assembly so as to effect release of said resilient detent mechanism.

8. The chair assembly according to claim 7, wherein said resilient detent mechanism includes a securement member movably mounted to said first mounting part and a detent recess in said second mounting part, said securement member being biased outwardly from said first mounting part at a biasing force and engaging said detent recess to releasably secure said first and second mounting parts together and disengaging said detent recess when said separation force is applied to said worksurface assembly to overcome said biasing force.

9. A chair assembly, comprising a chair having a chair arm fixed to the chair and disposed adjacent at least one side thereof, the chair arm having an upwardly facing arm part positioned for engagement with an occupant's arm, the chair arm also having a first mounting part provided thereon and positioned underneath the arm part, a worksurface assembly including a worksurface member having a horizontally enlarged upper surface defining a worksurface and having a base mounted to an underside of said worksurface member, said base having a second mounting part releasably engaged with said first mounting part to removably mount said worksurface assembly on said chair arm, and a releasable retaining structure for normally removably securing said second mounting part in engagement with said first mounting part, said releasable retaining structure being beneath said upper surface when said second mounting part is in engagement with said first mounting part.

10. The chair assembly according to claim 9, wherein one of said mounting parts includes a stem and the other of said mounting parts includes a socket removably receiving said stem so as to removably secure said worksurface assembly to said chair arm.

11. The chair assembly according to claim 9, wherein said first mounting part includes a stem and said second mounting part includes a socket removably receiving said stem so as to removably secure said worksurface assembly to said chair arm.

12. The chair assembly according to claim 11, wherein said stem extends from said chair arm and said socket is positioned in said base, said socket being directly beneath said upper surface.

13. The chair assembly according to claim 12, wherein said stem is disposed beneath said upwardly facing arm part and is releasably secured in said socket.

14. A chair assembly, comprising a chair having a chair arm disposed adjacent at least one side thereof, the chair arm having a first mounting Dart provided thereon, a worksurface assembly including a worksurface member having an enlarged upper surface defining a worksurface and having a base mounted to an underside of said worksurface member, said base having a second mounting part releasably engaged with said first mounting part to removably mount said worksurface assembly on said chair arm, a releasable retaining structure for normally removably securing said second mounting part in engagement with said first mounting part, said worksurface member comprising a tablet defining thereon said upper surface, a pivot pivotally securing said tablet to said base and defining a substantially vertical pivot axis, and a detent mechanism pivotally positioning said tablet relative to said base in a plurality of positions spaced horizontally about said pivot axis.

15. The chair assembly according to claim 14, wherein said pivot axis extends transverse to said upper surface.

16. A chair assembly comprising:

a chair having a seat, a back, and a chair arm fixedly related relative to said seat and back and disposed adjacent one side thereof, said chair arm including an arm part which is spaced upwardly from the seat adjacent said one side thereof and which defines thereon an upwardly-facing top surface adapted for engagement with an occupant's arm, the chair arm also having a first mounting part provided thereon and positioned generally beneath the arm part so as to not interfere with the occupant's use of the chair arm;

a worksurface assembly detachably engagable with said chair arm so as to project horizontally outwardly from the chair arm to define a worksurface, said worksurface assembly including a tablet-like worksurface member having a horizontally enlarged upper surface which defines said worksurface, and a second mounting part fixedly carried on said worksurface member and releasably engaged with said first mounting part to detachably mount said worksurface assembly on said chair arm; and a releasable retaining structure for normally removably securing said second mounting part in engagement with said first mounting part while permitting said worksurface assembly to be manually detached from said chair in response to manual application of a separation force to the worksurface assembly.

17. A chair assembly according to claim 16, wherein said arm part adjacent a front end thereof has a slot formed therein below said top surface and opening horizontally for accommodating therein a rear edge portion of the tablet-like worksurface member when the worksurface assembly is mounted on the chair arm.

18. A chair assembly according to claim 16, wherein the first mounting part is disposed adjacent a front end of the arm part remote from the chair back and the worksurface assembly projects forwardly from the arm part when mounted on the chair arm.

19. A chair assembly according to claim 16, wherein said chair arm is cantilevered forwardly from said chair back, and said worksurface assembly removably mounts solely to said chair arm adjacent a forward free end thereof so that said worksurface assembly projects forwardly from the chair arm.

20. A chair assembly according to claim 16, wherein said second mounting part is disposed directly beneath the upper surface of said worksurface member so that the worksurface assembly, when detached from the chair arm, can be readily manually supported and used as a portable worksurface.

* * * * *

UNITED STATES PATENT AND TRADEMARK OFFICE

CERTIFICATE OF CORRECTION

PATENT NO. : 5,954,393
DATED : September 21, 1999
INVENTOR(S) : Thomas M. PERRIN It is certified that error appears in the above-identified patent and that said Letters Patent is hereby corrected as shown below:

Column 8, line 51; change "Dart" to ---part---.

Signed and Sealed this

First Day of August, 2000

*Attest:*

*Attesting Officer*

Q. TODD DICKINSON

*Director of Patents and Trademarks*